US006157801A

United States Patent [19]

Aita et al.

[11] Patent Number: 6,157,801

[45] Date of Patent: Dec. 5, 2000

[54] MAGNETIC PARTICLES FOR CHARGING, CHARGING MEMBER, CHARGING DEVICE, PROCESS CARTRIDGE, AND ELECTROPHOTOGRAPHIC APPARATUS

[75] Inventors: Shuichi Aita, Mishima; Fumihiro Arahira, Shizuoka-ken; Kiyoshi Mizoe, Numazu; Toshio Takamori, Yokohama, all of Japan

[73] Assignee: Canon Kabushiki Kaisha, Tokyo, Japan

[21] Appl. No.: 09/328,796

[22] Filed: Jun. 9, 1999

[30] Foreign Application Priority Data

Jun. 11, 1998 [JP] Japan ..... 10-163787

[51] Int. Cl.[7] ..... G03G 15/02

[52] U.S. Cl. ..... 399/175; 361/221

[58] Field of Search ..... 399/174, 175, 399/168, 149, 150, 267; 430/111, 106.6; 361/221, 225

[56] References Cited

U.S. PATENT DOCUMENTS

| | | | |
|---|---|---|---|
| 5,367,365 | 11/1994 | Haneda et al. | 399/174 |
| 5,835,821 | 11/1998 | Suzuki et al. | 399/174 X |
| 5,930,566 | 7/1999 | Ishiyama | 399/168 |

FOREIGN PATENT DOCUMENTS

| | | |
|---|---|---|
| 0 593 245 | 4/1994 | European Pat. Off. . |
| 0 689 103 | 12/1995 | European Pat. Off. . |
| 59-133569 | 7/1984 | Japan . |
| 59-133573 | 7/1984 | Japan . |
| 62-203182 | 9/1987 | Japan . |
| 63-133179 | 6/1988 | Japan . |
| 1-020587 | 1/1989 | Japan . |
| 2-51168 | 2/1990 | Japan . |
| 2-302772 | 12/1990 | Japan . |
| 4-21873 | 1/1992 | Japan . |
| 5-2287 | 1/1993 | Japan . |
| 5-2289 | 1/1993 | Japan . |
| 5-53482 | 3/1993 | Japan . |
| 5-61383 | 3/1993 | Japan . |
| 6-118855 | 4/1994 | Japan . |
| 6-186821 | 7/1994 | Japan . |
| 6-258918 | 9/1994 | Japan . |
| 6-274005 | 9/1994 | Japan . |
| 6-301265 | 10/1994 | Japan . |
| 8-006355 | 1/1996 | Japan . |

*Primary Examiner*—Sophia S. Chen
*Attorney, Agent, or Firm*—Fitzpatrick, Cella, Harper & Scinto

[57] ABSTRACT

A magnetic particle for charging is disclosed. The magnetic particle includes magnetic particles having particle diameters of 5 μm or more. The magnetic particles having particle diameters of 5 μm or more have a standard deviation of short-axis length/long-axis length of 0.08 or more, and a volume resistance value in the range of $10^4$ to $10^9$ Ωcm. Also, provided are a charging member, a charging device, a process cartridge and an electrophotographic apparatus, using the magnetic particle.

69 Claims, 1 Drawing Sheet

MAGNETIC PARTICLES FOR CHARGING, CHARGING MEMBER, CHARGING DEVICE, PROCESS CARTRIDGE, AND ELECTROPHOTOGRAPHIC APPARATUS

BACKGROUND OF THE INVENTION

1. Field of the Invention

The present invention relates to magnetic particles used in a member for charging an object, a charging device using this charging member, a process cartridge and an electrophotographic apparatus, and they are applicable to devices such as copying machines, printers and facsimile machines.

2. Related Background Art

Heretofore, there are known many electrophotographic methods. In general, each of these methods employs a photoconductive material, forms an electrical latent image on a photosensitive member by any of various means, and then develops the latent image with a toner to form a visible image. If necessary, after transferring the toner image to a transfer material such as a paper, the toner image is fixed on the transfer material by heat or pressure to obtain a copy. Then, the toner particles remaining on the photosensitive member that are not transferred to the transfer material are removed from the photosensitive member by a cleaning process.

As a photosensitive member charging means by such an electrophotographic method, there is a charging method employing corona discharge, the so-called corotron or scotron. In addition, a charging method has been developed in which a charging member such as a roller, a fur brush or a blade is placed in contact with the surface of the photosensitive member, whereby discharge is formed in a narrow space in the vicinity of this contact to suppress the generation of ozone as much as possible, and this charging method is in practical use.

However, in the charging method utilizing the corona discharge, a great amount of ozone is generated particularly during the formation of the negative or the positive corona, and hence, it is necessary that a filter should be disposed on the electrophotographic apparatus to capture ozone, and this inconveniently increases the size and the running cost of the apparatus. Furthermore, in a method in which the charging is performed by placing a charging member such as a blade or a roller in contact with the photosensitive member, a problem that the toner melt-adheres to the photosensitive member tends to easily arise.

Therefore, a method in which the charging member is placed not in direct contact with but in the vicinity of the photosensitive member is being investigated. Examples of a member for charging the photosensitive member include the above-mentioned roller and blade, a brush and a long thin electroconductive plate having a resistance layer.

However, this method has a problem that it is difficult to control a distance between the charging member and the photosensitive member, which disturbs its practical use.

Thus, there has been investigated a technique which uses, as a charging member, the so-called magnetic brush formed by holding, with a magnet, magnetic particles having a relatively small load due to contact with the photosensitive member. Two charging methods using the magnetic particles in combination with the photosensitive member have been proposed. One is a method for charging the photosensitive member by forming a charge injection layer as a surface layer of the photosensitive member and then injecting an electric charge directly through contact with the charge injection layer. The other method employs discharge in the microscopic gaps between the surface of the photosensitive member and the magnetic particles using the usual photosensitive member.

In Japanese Patent Application Laid-Open No. 59-133569, a method is disclosed in which, for the magnetic particles used as the charging member, particles coated with iron powder are held on a magnet roll and charged by applying a voltage. However, with this method it is difficult to obtain a stable charging performance during continuous use. Japanese Patent Application Laid-Open No. 6-301265 proposes a construction that aims to stabilize resistance by replenishing the toner in order to standardize the amount of toner within the magnetic brush. These methods utilize discharge in the microscopic gaps, and problems such as damage to or degradation of the surface of the photosensitive member due to products from the discharge, and image slip or flow, which results easily at high temperature and high moisture levels, still remain.

Mixtures of relatively small diameter, highly electroconductive particles with relatively high resistance and low electroconductivity particles have also been proposed. Japanese Patent Application Laid-Open No. 6-258918 describes the use of a mixture of particles with volume resistance values of $10^8$ to $10^{10}$ Ωcm and diameters of 30 to 100 μm with particles with volume resistance values under $10^8$ Ωcm and diameters of 30 to 100 μm as particles for charging. Japanese Patent Application Laid-Open No. 6-274005 describes the use of a mixture of particles with volume resistance values of over $5\times10^5$ Ωcm with particles with volume resistance values under $5\times10^4$ Ωcm as particles for charging.

These offer good charging performance due to the diameter and resistance of the mixed particles, but when the resistance values of the particles largely differ, even if the diameters of the mixed particles are relatively close, during use the particles with low resistance will gather on the surface of the photosensitive member. As a result, even if initially the anti-pinhole quality was good, during use pinhole leaks tend to arise. If the particle diameters differ, the tendency for the low resistance particles to separate can be suppressed, but there is a strong tendency for particles with low resistance to leak out, particularly in low moisture environments.

Japanese Patent Application Laid-Open No. 8-6355 proposes a mixture of magnetic particles with bumpy surfaces and magnetic particles with smooth surfaces. It states that this will increase durability, but further increased durability is desirable.

Above, various proposals are mentioned, but as far as the present inventors understand the meaning of practical use, there are no examples of a magnetic brush being used as a charging member for photosensitive members in an electrophotographic apparatus such as a copying machine on the market. As for using magnetic particles as charging members for a photosensitive object, there has been insufficient examination into what materials are preferable and their effects, and development of the suitable structure for magnetic particles used for charging is desirable.

Conventionally, blade cleaning, fur brush cleaning, and roller cleaning have been used as cleaning processes in electrophotography. In all of these methods, the remaining transfer toner was mechanically swept out or dammed up and gathered into a waste toner container. Accordingly, problems resulting from such cleaning material being pushed across the surface of the photosensitive member arose.

For example, the photosensitive member could be scraped when the cleaning material is pushed against it with force, shortening the life of the photosensitive member. Also, the device must necessarily be made larger in order to equip it with such a cleaning device, an obstruction to the object of making the device more compact. From an ecological standpoint, a system in which waste toner does not result and the toner is efficiently used is desirable.

There is a technology called simultaneous development and cleaning, or development simultaneous with cleaning, or cleanerless, in which the development means is an actual cleaning means, in other words a system that performs cleaning through a development means but does not have a cleaning means for recycling and storing toner remaining on the photosensitive member after transfer, between the transfer device and the charging device and between the charging device and the developing device. For example, as described in Japanese Patent Application Laid-Open Nos. 59-133573, 62-203182, 63-133179, 64-20587, 2-51168, 2-302772, 5-2287, 5-2289, 5-53482, and 5-61383. However, these published technologies use a corona, a fur brush, or a roller as charging means, and are not satisfactory in all areas, such as contamination of the surface of the photosensitive member by products from discharge and nonuniformity of charge.

Thus, a cleanerless technology using a magnetic brush as charging member is being examined. For example, in Japanese Patent Application Laid-Open No. 4-21873 an image formation apparatus is proposed wherein a cleaning device is unnecessary because a magnetic brush to which an alternating voltage has been applied having a peak value exceeding the discharge limit value is used. Further, in Japanese Patent Application Laid-Open No. 6-118855, an image formation apparatus is proposed in which a magnetic brush charging cleaning device without an independent cleaning device is built on.

Metals such as iron, chromium, nickel, and cobalt, alloys or compounds of these, triiron tetroxide, γ-ferric oxide, chromium dioxide, manganese oxide, ferrite, or manganese-copper alloys, or these materials coated with styrene resin, vinyl resin, ethylene resin, rosin modified resin, acrylic resin, polyamide resin, epoxy resin, or polyester resin, or a resin containing dispersed magnetic material microparticles are given as examples of the magnetic particles used.

However, the desirable form for the charging magnetic particles is not disclosed, and points such as the suitable magnetic particles for cleanerless method are left for further examination.

SUMMARY OF THE INVENTION

It is an object of the present invention to provide magnetic particles for charging having a stable charge during continuous use and with greater durability than conventional chargers, a charging member using the magnetic particles, a charging device, a process cartridge, and an electrophotographic apparatus.

It is a further object of the present invention to provide a process cartridge and an electrophotographic apparatus with low wear on the photosensitive member.

It is a further object of the present invention to provide a charging device and an electrophotographic apparatus equipped with a cleanerless system using a charging magnetic brush stable over long periods of time.

In other words, the present invention includes magnetic particles for charging comprising magnetic particles having particle diameters of 5 μm or more, said magnetic particles having particle diameters of 5 μm or more having a standard deviation of short-axis length/long-axis length of the magnetic particles of 0.08 or more, and a volume resistance value in the range of $10^4$ to $10^9$ Ωcm.

Further, the present invention is a charging member comprising a magnet body having a conductive portion to which voltage is applied; and magnetic particles on the magnet body, said magnetic particles comprising magnetic particles having particle diameters of 5 μm or more, said magnetic particles having particle diameters of 5 μm or more having a standard deviation of short-axis length/long-axis length of the magnetic particles of 0.08 or more, and a volume resistance value in the range of $10^4$ to $10^9$ Ωcm.

The present invention is a charging device comprising a charging member disposed in contact with an image carrier to charge the image carrier when voltage is applied thereto, said charging member comprising a magnet body having a conductive portion to which the voltage is applied and magnetic particles on the magnet body, said magnetic particles comprising magnetic particles having particle diameters of 5 μm or more, said magnetic particles having particle diameters of 5 μm or more having a standard deviation of short-axis length/long-axis length of the magnetic particles of 0.08 or more, and a volume resistance value in the range of $10^4$ to $10^9$ Ωcm.

The present invention is further a process cartridge comprising an electrophotographic photosensitive member; and a charging member disposed in contact with the electrophotographic photosensitive member to charge the electrophotographic photosensitive member when voltage is applied thereto, the electrophotographic photosensitive member and the charging member being integrally supported, and detachably attached to a main body of an electrophotographic apparatus, said charging member comprising a magnet body having a conductive portion to which the voltage is applied and magnetic particles on the magnet body, said magnetic particles comprising magnetic particles having particle diameters of 5 μm or more, said magnetic particles having particle diameters of 5 μm or more having a standard deviation of short-axis length/long-axis length of the magnetic particles of 0.08 or more, and a volume resistance value in the range of $10^4$ to $10^9$ Ωcm.

The present invention is an electrophotographic apparatus comprising an electrophotographic photosensitive member; a charging means having a charging member disposed in contact with the electrophotographic photosensitive member to charge the electrophotographic photosensitive member when voltage is applied thereto; a developing means; and a transfer means, said charging member comprising a magnet body having a conductive portion to which the voltage is applied and magnetic particles on the magnet body, said magnetic particles comprising magnetic particles having particle diameters of 5 μm or more, said magnetic particles having particle diameters of 5 μm or more having a standard deviation of short-axis length/long-axis length of the magnetic particles of 0.08 or more, and a volume resistance value in the range of $10^4$ to $10^9$ Ωcm.

DETAILED DESCRIPTION OF THE PREFERRED EMBODIMENTS

Figure 1:
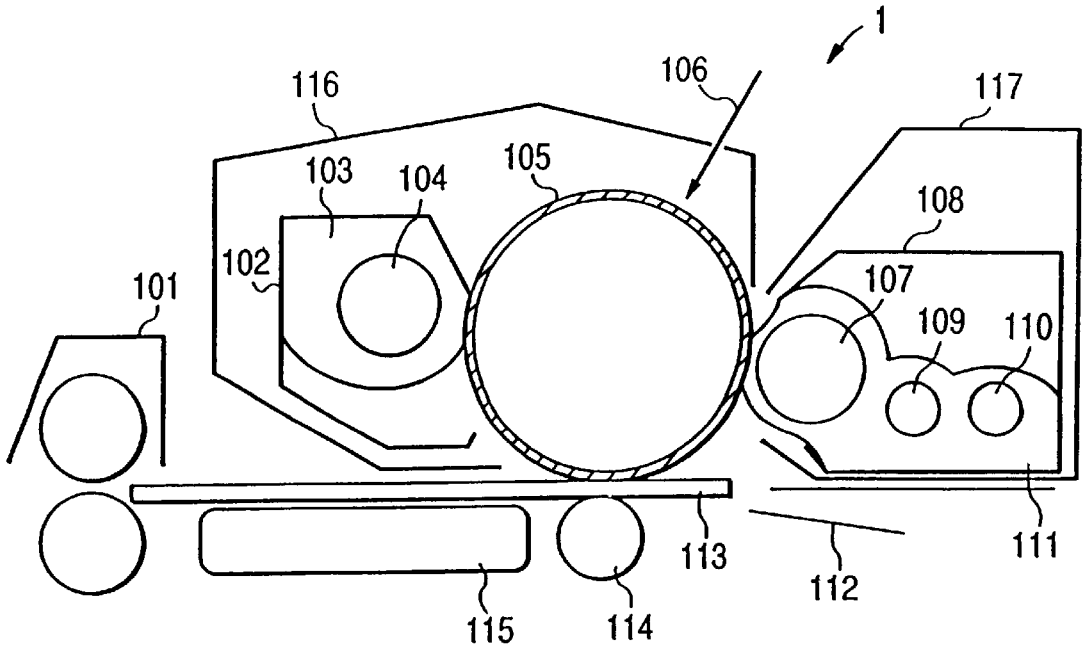
FIG. 1 is a schematic drawing of the construction of an electrophotographic type digital copying machine.

Various particles can be mentioned and noted as examples of magnetic particles for charging as above. However, according to the results of the present inventors' examinations, the magnetic particles used conventionally have many unsatisfactory points as magnetic particles for charging photosensitive member. After closely looking into these circumstances the present inventors have discovered one preferable form and completed the present invention.

The magnetic particles of the present invention with particle diameters of not less than 5 $\mu$m have a standard deviation of the short axis length/long axis length of not less than 0.08 and a volume resistance value of $10^4$ to $10^9$ Ωcm. With such a construction high durability and good image quality is obtained. As a result of declining durability the surface of the magnetic particles is contaminated by foreign alien matter such as toner, toner components, or paper dust that enters the charging member, the resistance value of the charging member increases, and the surface of the photosensitive member can no longer be sufficiently charged. In particular, the photosensitive member can not be sufficiently charged over long periods of time in environments with low humidity, in other words when it is difficult to maintain sufficient durability.

The influences on the image caused by this problem are as follows. Taking for example a durable image when reverse development is used, even if the image is initially without problems, as use continues, ghost images arise on the periphery of the photosensitive member. At this time the electric potential of the photosensitive member charged is the same as in the initial period. As use continues further, background fog arises. At this time the electric potential of the photosensitive member charged has declined from that of the initial period and an electric potential sufficient to obtain an image without fog cannot be achieved.

In this connection, the ghost image is caused by different potentials between the exposed portion and the unexposed portion on the photosensitive member. That is to say, the ghost image is caused by a fact that charging uniformity at the charging of a low potential portion (an exposed portion) is poorer than charging uniformity at the charging of a high potential portion (an unexposed portion). Therefore, the history of the potential on the photosensitive member is seen as the ghost image.

The mechanism giving rise to the above image defects is as follows:

(1) The difference in the charged electric potential between the exposed portion of the photosensitive member and the unexposed portion is great.

(2) Toner ingredients that were not completely cleaned up remain on the exposed portion of the photosensitive member, hindering contact between the surface of the photosensitive member and the particles and causing irregularities in the charged electric potential. These problems are specific to contact charging methods using particles; there is no correlation to image quality as long as the electric potential of the photosensitive member is measured, as in conventional methods. This characteristic is also not found with magnetic particles for a development carrier.

In the case of a so-called cleanerless image formation apparatus that does not have an independent cleaning means, the problem of ghost images is particularly severe because the portion where transfer toner remains and the portion of the photosensitive member that is exposed are the same.

Thus, using a cleanerless image formation apparatus as an example when explaining the effect of using the present invention, the following effects are obtained by using the magnetic particles of the present invention:

(1) Contact between the magnetic particles and the surface of the photosensitive member improves, and charging of the photosensitive member can be sufficiently accomplished even if there is remaining transfer toner.

(2) There is a surface cleaning effect among the magnetic particles themselves, which suppresses the accumulation of foreign matter on the surfaces of the particles even over long periods of time, so the method is effective with great continuity.

As a result, in environments of low moisture, even if large quantities of matter impeding contact exist on the photosensitive member, it is possible to form a stable image over long periods of time. Because there is a large quantity of toner among the magnetic particles, one can not expect contact among the magnetic particles to cause a surface cleaning function. In this way, the qualities sought for the environment surrounding the magnetic particles for charging are completely different from the qualities sought for developing.

If the standard deviation of short axis length/long axis length for particles with diameters of not less than 5 $\mu$m is less than 0.08, variation of shapes will be too slight and the mutual surface cleaning effect will be insufficient. Due to the variation in shapes, certain shapes are suitable for cleaning certain shapes of magnetic particles and for the loads of the charging magnetic particles, and it is thought that a surface cleaning effect is achieved where the loads concentrate. If the standard deviation of short axis length/long axis length for particles with diameters of 5 $\mu$m to 20 $\mu$m is not less than 0.08, the surface cleaning effect on the larger particles is great and this is a suitable construction. If the standard deviation is not less than 0.10 the cleaning effect is even greater and this is even more desirable.

Next the measurement method of the standard deviation of short axis length/long axis length is described. Using a Hitachi factory produced FE-SEM (S-800), a random sample of 100 particle images enlarged 500 times is taken and based on this image information, the image analyzed results are statistically processed by an Image Analyzer V10 (Toyo Boseki Co.) for example. An image signal from an electron micrograph is first entered into the analysis device via a stereomicroscope, and then the image information is given two values. Next the following analysis is performed based on the image information made into two values.

The manual of the Image Analyzer V10 (Toyo Boseki Co.) provides the details, but to explain the basic method, the shape of the object is replaced with an ellipse and the ratio of the length of the long axis to the length of the short axis of that ellipse is taken. This process is as follows.

If the specific gravity of the micro area $\Delta s=\Delta u\cdot\Delta v$ of coordinates (u,v) for the shape of the magnetic particles given two values is set at 1, the secondary moments of the horizontal axis and the vertical axis (the secondary moment of horizontal axis is Mx; the secondary moment of the vertical axis is My) with origin (X,Y) and passing through the center of gravity of the shape of the particles given two values, are expressed as:

$$Mx=\Sigma\Sigma(u-X)^2$$

$$My=\Sigma\Sigma(v-y)^2$$

The inertial synergistic moment Mxy is expressed:

$$Mxy=\Sigma\Sigma(u-X)\cdot(v-Y)$$

and the angle θ found with the formula below has two solutions.

$$\theta=\tfrac{1}{2}\cdot(2Mxy/Mx-My)$$

The inertial moment Mθ in the axial direction formed by the horizontal axis and the angle θ is expressed:

$$M\theta=Mx\cdot(\cos\theta)^2+My\cdot(\sin\theta)^2-Mxy\cdot\sin 2\theta$$

Putting in the two solutions for the angle θ, the smaller of the two values calculated for Mθ is the main axis.

When the points corresponding to $(1/M\theta)^{0.5}$ on the designated axis are plotted they form an ellipse. If the main axis is made to agree with the inertial main axis and the direction taken by the smaller value for Mθ is A and the larger B, the following ellipse results:

$$A\cdot x^2+B\cdot y^2=1$$

The short axis length/long axis length in the present invention for the above ellipse is expressed:

$$\text{Short axis length/long axis length}=(A/B)^{0.5}$$

The standard deviations of the magnetic particles having particle diameters of 5 μm or more and the magnetic particles having particle diameters of 5 μm to 20 μm can be obtained by the analysis of the particles having a maximum chord length of 5 μm or more and a maximum chord length of 5 μm to 20 μm with an electron micrograph.

The average particle diameter and dispersion of magnetic particles for charging is measured by dividing the range from 0.5 μm to 350 μm by a 32 logarithm using a laser diffraction type particle size distribution measuring device (made by Nihon Denshi) and setting the average particle diameter by the median diameter at 50% volume.

In the present invention, the average particle diameter of the magnetic particles for charging may preferably be 10 to 200 μm. If the particles are smaller than 10 μm they leak easily and the conveyability of the magnetic particles when formed as a magnetic brush deteriorates. When using the particles in an injection charging method, if they exceed 40 μm the uniformity of charging in the injection charging method of the present invention tends to deteriorate. Thus, particules having diameters of 15 to 30 μm are more preferable.

Ferrite particles are preferable as the magnetic particles used in the present invention. Compositions including metallic elements such as copper, zinc, manganese, magnesium, iron, lithium, strontium, and barium are suitable for the ferrite.

A method in which 20 μm to 200 μm ferrite particles are pulverized is a suitable manufacture method for the ferrite particles in the present invention. After pulverizing while controlling the shape distribution, the particles are classified appropriately and can be used immediately. If necessary, they can be used mixed with other particles. It is also possible to manufacture by pulverizing lumps of ferrite, but from the standpoint of efficiency pulverizing ferrite particles is preferable.

As a conventional example, magnetic particles made by mixing magnetite and resin followed by pulverizing have been used, but the magnetic particles tend to leak quite a bit from the charging member because they contain large quantities of resin components. Furthermore, the percentage of resin on the surface of the resin magnetic particles is high, and the percentage of magnetic particles, which are the conducting path, is low. As a result, the resistance value easily rises due to surface contamination from foreign matter, and a sufficient increase in durability may not be obtained.

The magnetic particles for charging of the present invention are preferably ferrite particles containing copper, manganese or lithium and iron, most preferably ferrite particles containing copper or manganese and iron.

The preferable composition ratio is represented by:

$$(A_1)_{X1}\cdot(A_2)_{X2}\ldots(An)_{Xn}\cdot(Fe)_Y\cdot(O)_Z$$

wherein $A_1$ to An denote element $A_1$ selected from copper, manganese and lithium, and $X_1$ to Xn, Y and Z denote atom number ratios of elements contained, $X_1$ to Xn and Y denote atom number ratios of contained elements other than oxygen, satisfy the inequality $0.02<X_1/Y<5$ and Z denotes an atom number rates of oxygen.

They are more preferably $0.03<X_1/Y<3.5$, further preferably $0.05<X_1/Y<1$.

For $A_2$ and subsequent preferable elements, they are not used in $A_1$, and include copper, manganese, lithium, zinc and magnesium.

Additionally, the ferrite particles of the present invention can contain phosphorus, sodium, potassium, calcium, strontium, bismuth, silicon, aluminum and the like.

As a preferable constitution of the charging magnetic particles, in the total atom number of the elements excluding oxygen in the magnetic particles, the number of contained atoms of iron, copper, manganese, lithium, zinc and magnesium is preferably 80 atom number % or more for use, more preferably 90 atom number % or more, most preferably 95 atom number % or more.

Ferrite is a solid solution of oxide, and not necessarily based on a strict stoichiometry. When copper is used, however, ferrite can be represented by:

$$(CuO)_{X1}\cdot(Fe_2O_3)_{X1}\cdot(A_2)_{X2}\ldots(An)_{Xn}\cdot(Fe)_{Y-2X1}\cdot(O)_{Z-4X1}.$$

When manganese is used, ferrite is represented by:

$$(MnO)_{X1}\cdot(Fe_2O_3)_{X}\cdot(A_2)_{X2}\ldots(An)_{Xn}\cdot(Fe)_{Y-2X1}\cdot(O)_{Z-4X1}.$$

When lithium is used, ferrite is represented by:

$$(Li_2O)_{X1/2}\cdot(Fe_2O_3)_{5X1/2}\ldots(A_2)_{X2}\cdot(An)_{Xn}\cdot(Fe)_{Y-5X1}\cdot(O)_{Z-8X1}.$$

For the charging magnetic particles, according to their characteristic use modes, they are effectively superior particularly in durability in particles in which copper, manganese and lithium are used. Particularly, when copper and manganese are used, a large effect is obtained.

This mechanism is now intensively being investigated, and it can be presumed that when the photosensitive member is charged by the application of a voltage, a current flows through the ferrite, but the formation of current paths for this current depends on an element, and particularly in the ferrite comprising copper or manganese, many current paths are formed. Moreover, it can also be presumed that the ferrite has a surface state which permits smoothing the handling of the charges with the photosensitive member.

Further, the magnetic particles for charging of the present invention should preferably have a volume resistance value of from $1\times10^4$ Ωcm to $1\times10^9$ Ωcm. If this value is less than $1\times10^4$ Ωcm, pinhole leaks result, and if it is greater than $1\times10^9$ Ωcm, the photosensitive member will be insufficiently charged. From the standpoint of magnetic particle leakage, the volume resistance value should preferably be from $1\times10^6$ Ωcm to $1\times10^9$ Ωcm.

Figure 2:
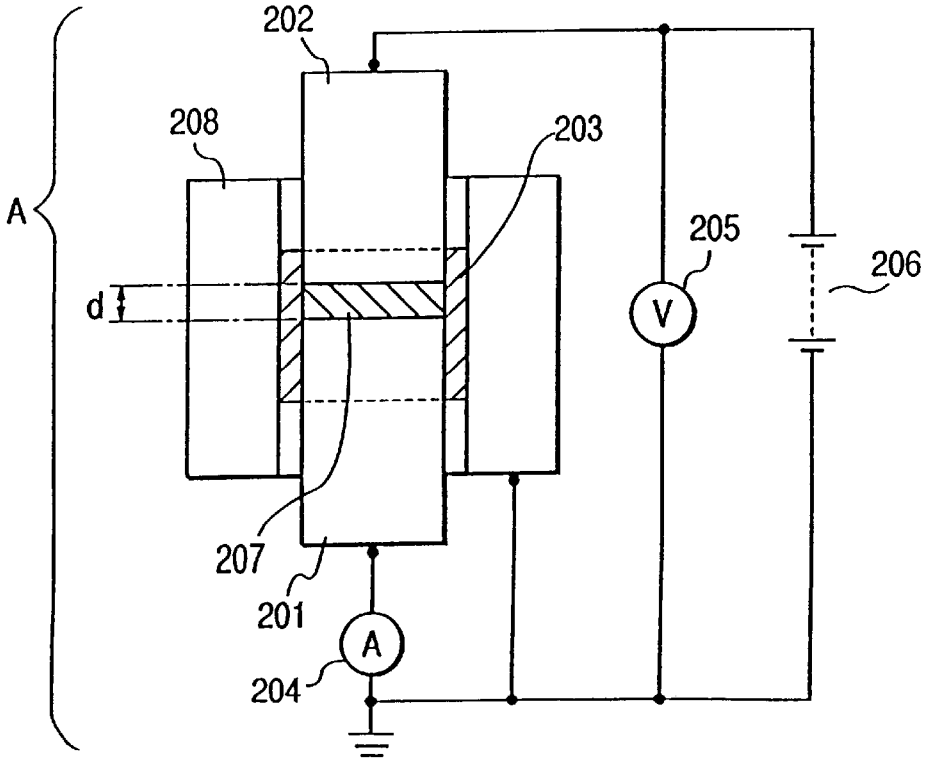
FIG. 2 is a schematic cross-section of a measurement apparatus for volume resistance value of magnetic particles.

The volume resistance value of the magnetic particles is obtained by filling cell A shown in FIG. 2 with magnetic particles, placing electrodes 201 and 202 in contact with the magnetic particles, applying a voltage between these electrodes and measuring the current flowing during that time. Measurement should be performed at a temperature of 23° C. and relative humidity of 65%, area of contact between the magnetic particles and the electrodes 2 $cm^2$, thickness (d) of 1 mm, a load on the upper electrode of 10 kg, and applied voltage of 100 V. In FIG. 2, 203 is a guide ring, 204 is an ammeter, 205 is a voltmeter, 206 is voltage stabilizer, 207 is a measurement sample of thickness d, and 208 is an insulator.

In the present invention, the difference in the resistance between the relatively large magnetic particles and the relatively small magnetic particles should be small. When the volume resistance value of the magnetic particles having particle diameters from 5 μm to 20 μm is Ra and the volume resistance value of the magnetic particles having particle diameters exceeding 20 μm is Rb, then:

$$0.5 \leqq Ra/Rb \leqq 5.0$$

Still more preferable is:

$$1.0 \leqq Ra/Rb \leqq 5.0$$

Magnetic particles with particle diameters of 5 μm to 20 μm and magnetic particles with particle diameters exceeding 20 μm are separated in the following way.

Prepare sieves with 5 μm, 20 μm, and 25 μm openings. These sieves should be Ø75 mm×H20 mm size and the openings can be obtained by making the sieve wires thicker by plating if necessary. Stack up the sieves with the openings in order of 25 μm, 20 μm, and 5 μm from above. place 0.5 g magnetic particles in the 25 μm opening sieve, shake well, and collect the magnetic particles that pass through the 20 μm sieve and remain on the 5 μm sieve. Then eliminate the particles that pass the 5 μm sieve by differential pressure of 200 mm Aq added to the particles remaining on the 5 μm sieve. These samples are used for measurement. The sample of particles exceeding 20 μm are a mixture of magnetic particles on the 20 μm opening sieve and the 25 μm opening sieve. Measuring of the volume resistance value is as mentioned above.

If the resistance value of the relatively small diameter particles is lower than 1/10 of the resistance value of the relatively large diameter particles, or if an oscillating voltage is applied to the charging member, there is a strong tendency in low moisture environments for the particles with relatively small particle diameters and low resistance to fall off the charging member. This tendency is particularly strong in cleanerless image formation methods. When using a mixture of particles with relatively similar particle diameters but resistance values differing by more than a single digit, during use the particles with low resistance will lean toward the side of the surface of the photosensitive member and pinhole leaks result from the imbalance of the low resistance particles.

In order to make the present invention even more effective, the magnetic particles of the present invention should preferably be processed using a coupling agent containing a structure of 6 or more carbon atoms directly linked in a straight chain. Because the magnetic particles for charging are rubbed vigorously against the photosensitive member, this scraping is severe, particularly on organic photosensitive members. With the construction of the present invention, the long chain alkyl groups grant a lubricating function that is effective against damage to the photosensitive member as well as effective against contamination of the surface of the magnetic particles for charging. It is particularly effective if the surface of the photosensitive member is composed of an organic compound.

From this standpoint, preferably, the alkyl group should contain 6 or more carbon atoms linked, or even 8 or more carbon atoms linked, but should preferably contain up to 30 carbon atoms. If the carbon atoms are less than 6, it is difficult to obtain the effect described above. If the carbon atoms exceed 30, those coupling agents tend to be insoluble in solvent, it becomes difficult to process the surface of the magnetic particles uniformly, the fluidity of the processed magnetic particles for charging deteriorates, and charging tends to become irregular.

The amount of coupling agent should be not less than 0.0001% and not more than 0.5% by mass based on the magnetic particles for charging containing the coupling agent. If less than 0.0001% by mass the effect of the coupling agent is not achieved, and if over 0.5% by mass the fluidity of the magnetic particles for charging deteriorates and charging may become irregular. The amount of coupling agent more preferably is 0.001% to 0.2% by mass.

The amount of the coupling agent can be evaluated through weight reduction by heating. A weight reduction by heating of not more 0.5% by mass is preferable, and not more than 0.2% is more preferable. Here, weight reduction by heating means the reduction in mass when heated from a temperature of 150° C. to 800° C. in a nitrogen atmosphere and analyzed with a thermobalance.

In the present invention, it is preferable for the surface of the magnetic particles for charging to be constructed only of coupling agent, but it is possible to coat the surface with a very small amount of resin as well. In this case, the resin should preferably used in an amount equal to or less than the amount of coupling agent. These may also be used in combination with magnetic particles for charging coated with resin. In this case up to 50% of the total mass of the magnetic particles within the charger should be made up of resin coated magnetic particles. If resin coated magnetic particles exceed 50% of the total mass, the effect of the magnetic particles of the present invention is diminished.

The coupling agent is a compound having in the same molecule a hydrolyzable group and a hydrophobic group bonded to a central element such as silicon, aluminum, titanium, or zirconium, which has a long chain alkyl in the hydrophobic group portion.

As the hydrolyzable groups, alkoxy groups such as a methoxy group, an ethoxy group, a propoxy group and a butoxy group with relatively high hydrophilic properties can be used. In addition, an acryloxy group, a methacryloxy group, their modified groups and halogens can also be used. Preferable hydrophobic groups are those containing 6 or more carbon atoms linked in a straight-chain state in their structure. If in a bonded form with a central element, they may be bonded directly, or through a carboxylate, an alkoxy, a sulfonate or a phosphate. A functional group such as an ether linkage, an epoxy group or an amino group may also be contained in the structure of the hydrophobic group.

Some concrete examples of compounds that can be used in the present invention are as follows:

$(CH_3O)_3—Si—C_{12}H_{25}$ $(CH_3O)_3—Si—C_{18}H_{37}$ $(CH_3O)_3—Si—C_8H_{17}$ $(CH_3O)_2—Si—(C_{12}H_{25})_2$

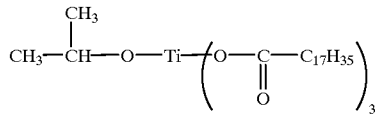

-continued

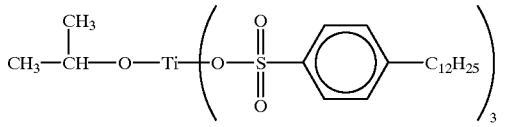

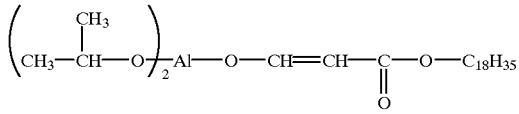

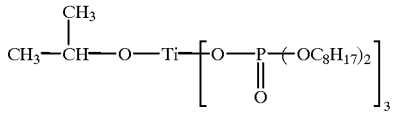

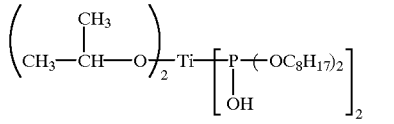

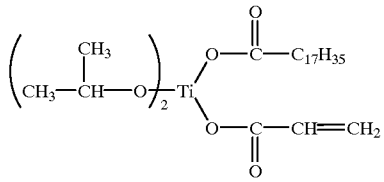

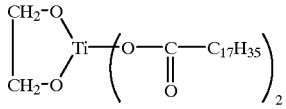

$C_6H_{13}-SiCl_3$

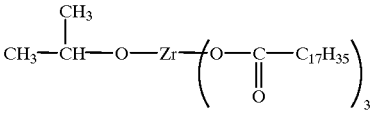

If the magnetic particles for charging of the present invention have a coupling agent on their surface, because the agent is less than 0.5% by mass, or preferably even 0.2% by mass, a resistance value approximately equivalent to that of magnetic particles without coupling agent on their surface is obtained. As a result stability during manufacture and stability of quality is high in comparison to such situations as when a resin having electroconductive particles dispersed is used.

The reaction rate of the coupling agent should be over 80% or preferably, over 85%. In the present invention, because a coupling agent having a comparatively long alkyl group is used, if the proportion of unreacted material is great, it will lead to degradation of fluidity. Also, if the surface of the photosensitive member used is substantially a non-cross-linking resin, the unreacted processing agent will permeate the surface of the photosensitive member and may cause clouding or cracks. For this reason a coupling agent that can react with the surface of the magnetic particles should be used.

As a method for measuring the reaction rate of a coupling agent, a solvent that can dissolve the coupling agent used should be selected and the ratio of coupling agent present before and after washing can be measured. For example, a means in which the processed magnetic particles are dissolved in 100 times their amount of solvent and the coupling agent components within the solvent are quantified through chromatography, and a means in which the coupling agent components remaining on the surface of the magnetic particles after washing are quantified through a method such as XPS, element analysis, or thermogravimetric analysis (TGA) and the amounts before and after washing are quantified, are both possible.

In the charging device and electrophotographic apparatus of the present invention, an injection charging method can be used with good results. By using a photosensitive member with a charge injection layer on the outermost layer of the supporting body on the electrophotographic photosensitive member, a charging electric potential of over 90% and an applied voltage of over 80% can be achieved with only a direct voltage applied to the charging member when using an injection charging method. Thus, with a charging method interpreted by Pashen's law, ozoneless charging can be enacted.

In order for the charge injection layer to satisfy the conditions for having sufficient charging property without causing image slippage, the volume resistance value should preferably be between $1\times10^{8}$ Ωcm to $1\times10^{15}$ Ωcm. For such points as image slippage, it is even more preferable for it to be within $1\times10^{10}$ Ωcm to $1\times10^{15}$ Ωcm, or if changes in the environment are considered, $1\times10^{12}$ Ωcm to $1\times10^{15}$ Ωcm are preferable. With volume resistance values of less than $1\times10^{8}$ Ωcm it is difficult to maintain the electrostatic latent image and image slippage arises easily particularly under conditions of high humidity and high temperatures. However, if the volume resistance value is greater than $1\times10^{15}$ Ωcm, electric charges from the charging member cannot be sufficiently received and charging failures tend to result.

In the charging device and electrophotographic apparatus of the present invention an oscillating voltage should preferably be applied to the photosensitive member charging member. One effect of applying an oscillating voltage is that a stable charge is obtained against external disturbances such as mechanical precision. If an oscillating voltage is applied when using an injection charging method such a benefit is obtained, but there is a limit to the applied oscillating voltage. Frequencies of 100 Hz to 10 kHz are preferable and the peak voltage should preferably be up to 1,000 V.

This is because when using an injection charging method the electric potential of the photosensitive member follows the path of the applied voltage; if the peak-peak voltage is too high the electric potential of the charging surface of the photosensitive member will rise and fog or reverse fog may arise. With an oscillating voltage, the peak-peak voltage should preferably be not less than 100 V, more preferably be not less than 300 V. A sine wave, rectangular wave, or sawtooth wave may be used as the wave shape.

It is possible to construct the charge injection layer of a material with a medium resistance by dispersing an appropriate quantity of light permeable, electroconductive particles in an insulating binding resin. Forming an inorganic layer with the above resistance is also an effective means. Such a surface layer as above will serve the purpose of maintaining the electric charge injected by the charging member and will decrease the remaining electric potential during exposure by allowing this charge to escape the photosensitive member holding member.

Here, a layer (23 μm thick) similar to the surface is formed on polyethylene terephthalate (PET) with vaporized gold on its surface, a voltage of 100 V is applied at a temperature of 23° C. and 65% relative humidity, and the volume resistance of this surface layer of the photosensitive member is measured with a volume resistance measurement device (4140B pAMATER, available from Hewlett Packard).

For light permeability, the magnetic particles should preferably have diameters of not more than 0.3 μm, and more preferably not more than 0.1 μm. For 100 parts by mass of the binding resin there should preferably be 2 to 250 parts by mass of the particles, more than 2 to 190 parts by weight. If there are less than 2 parts by mass, it is difficult to obtain the desirable volume resistance value, and if there are over 250 parts by mass, the strength of the film may decline and the charge injection layer is easily worn away. The charge injection layer should preferably have a membrane thickness of 0.1 to 10 μm, more preferably 1 to 7 μm.

The charge injection layer should preferably contain a lubricant powder. The expected effect of this is that friction between the photosensitive member and the charging member during charging will be reduced, the nip participating in the charging will be enlarged, and the charging characteristics are improved. Also, because the mold releasability of the surface of the photosensitive member improves, it becomes more difficult for the magnetic particles to adhere. It is particularly preferable to use such things as fluororesin, silicone resin, or polyolefin resin, with low critical surface tension, as the lubricating particles. Polytetrafluoroethylene resin is most preferable.

In this case, the amount of the lubricating powder added should preferably be 2 to 50 parts by mass, more preferably 5 to 40 parts by mass, based on 100 parts by mass of binding resin. If less than 2 parts by mass, there will be an insufficient amount of lubricating powder, the charging characteristics of the photosensitive member will be insufficiently improved, and in a cleanerless device, the amount of remaining transfer toner will increase. However if more than 50 parts by mass, the resolution of the image and the sensitivity of the photosensitive member will deteriorate.

When coating the surface layer with an insulating layer, the photosensitive layer underneath should preferably be made of amorphous silicon, and an inhibition layer, a photosensitive layer, and a charge injection layer should preferably be formed in that order on the cylinder through the glow discharge or the like. A conventionally known material can be used as the photosensitive layer. For example, such organic materials as phthalocyanine pigment or azo pigment may be used.

An intermediate layer can also be built between the charge injection layer and the photosensitive layer. Such an intermediate layer increases the adhesion between the charge injection layer and the photosensitive layer and it can be made to function as an electric charge barrier layer. Resinous materials on the market such as epoxy resin, polyester resin, polyamide resin, polystyrene resin, acrylic resin, or silicone resin can be used as this intermediate layer.

Metals such as aluminum, nickel, stainless steel, or steel, plastic or glass with an electroconductive membrane, or electroconductive paper can be used as a electroconductive supporting body for the photosensitive member.

Another effect of the present invention is that when the applied voltage is a direct voltage with an oscillating voltage added, the oscillation noise resulting from the oscillating electric field is reduced. It is thought that the oscillation is absorbed by the variation in shapes. This effect is greatest when the thickness of the electroconductive supporting body of the photosensitive member is not less than 0.5 mm and not more than 3.0 mm. If it is less than 0.5 mm, vibration noise easily increases and dimensional stability is poor, but if it is greater than 3.0 mm the rotation torque increases and the cost of the material rises.

There is also a preferable range for the triboelectric charging between the toner used and the magnetic particles of the charging member. At 7 parts of the toner used based on 100 parts of magnetic particles of the charging member, the triboelectricity value of the measured toner should be the same as for the charging polarity of the photosensitive member. If that absolute value is 1 to 90 mC/Kg, preferably 5 to 80 mC/Kg, more preferably 10 to 40 mC/Kg, the toner is well taken in and swept out and particularly good conditions for the quality of charging the photosensitive member are obtained.

The following is the preferable measurement method. First, a mixture of 200 mg toner added to 40 g of magnetic particles to be measured is placed in a 50 to 100 ml polyethylene bottle and shaken by hand 150 times at a temperature of 23° C. and relative humidity of 60%. Charge this mixture of toner and magnetic particles for charging as the magnetic particles for charging. Next, charge a metallic drum of the same dimensions as the photosensitive member, apply a direct current bias of the same polarity as the charging polarity of toner to the charging portion, drive the drum under the same conditions as those when charging the photosensitive member, and measure the amount of toner moved from the charging member onto the metallic drum.

In the electrophotographic apparatus of the present invention, a magnetic brush formed from magnetic particles is used as the charging member contacting the photosensitive member. However, a magnet roll or an electroconductive sleeve (a magnet with an electroconductive portion to which voltage is applied) with its surface coated uniformly with magnetic particles and having an internal magnet roll can also be used as the supporting member of the magnetic particles in the charging member. However, an electroconductive sleeve coated uniformly with magnetic particles on the surface and having a magnet roll is particularly suitable.

The closest gap between the magnetic particle supporting member for charging and the photosensitive member should preferably be 0.3 mm to 2.0 mm. If they are closer than 0.3 mm, leaks may arise between the electroconductive portion of the magnetic particle supporting member for charging and the photosensitive member due to the applied voltage, and the photosensitive member may be damaged. The moving direction of the magnetic brush for charging may be any direction of the same or counter direction relative to the moving direction of the photosensitive member at the contact portion therebetween. However, the magnetic brush should preferably move in the opposite direction as the photosensitive member from the standpoint of uniformity of charging and the ability to remove remaining transfer toner.

The amount of magnetic particles for charging supported on the supporting member should preferably be between 50 to 500 mg/cm$^2$, more preferably between 100 to 300 mg/cm$^2$. Within this range a stable charging performance can be obtained. Excess magnetic particles for charging within the charging device can be recycled.

When using a cleanerless image formation method, the stability of the electrophotographic apparatus can be further improved by controlling the electric potential of the photosensitive member before charging after the transfer process.

Materials that emit light and control the electric potential of the photosensitive member, or electroconductive rollers, blades, or fur brushes placed in contact with or in the vicinity of the photosensitive member can be used to control the electric potential of the photosensitive member. Among these, rollers and fur brushes are particularly suitable. When controlling the electric potential of the photosensitive member by applying a voltage to these materials, it is also preferable to control with the reverse polarity to the photosensitive member charging process. This will aid the charging uniformity by aligning the electric potential of the photosensitive member at a low level before charging and eliminating any history of the image formed earlier. Known means of exposure such as laser or LED can be used as exposure means in the present invention.

When using a cleanerless image formation device, a reverse development is preferable, in which the developer contacts the photosensitive member. Development processes such as contact two component development or contact one component development are suitable methods. When a developer and the remaining transfer toner make contact on the photosensitive member, the friction force is converted to a static electricity force and the remaining transfer toner can be efficiently removed by the developing means. When applying a bias during development, the direct current component should preferably come between the polarity of the black areas (the exposed portion in case of reverse development) and that of the white areas.

Known methods such as using a corona, roller, or belt may also be used as a transfer means.

In the present invention, the electrophotographic apparatus and the charging means, or if necessary the development means and the cleaning means may be made a single unit to form a detachably attachable process cartridge (116 in FIG. 1) on the main body of the electrophotographic apparatus. Alternatively, the development means can be made a separate cartridge from the cartridge having the electrophotographic apparatus (117 in FIG. 1).

In the present invention, it is not necessary to change the charging bias of the photosensitive member in order to temporarily recover the remaining transfer toner removed from the charger to the developing section using the surface of the photosensitive member and reuse it. However, if a jam occurs or when continuously producing images with a high image ratio an extremely large amount of transfer toner may remain.

In this case, it is possible to move the toner from the charger to the developer during image formation operations using a time when images are not being formed on the photosensitive member. Before rotation, after rotation, and between transfer papers are examples of such times when images are not being formed. In this case, it is also preferable to change to a charging bias with which it is easy to move the toner from the charger to the photosensitive member. Reducing the alternating current component of the peak voltage, changing to a direct current only, or reducing the effective current of the alternating current by changing the wave shape without changing the peak voltage are all methods of making removal of toner from the charger easier.

In the present invention, with regard to the lifespan of the charger and the use of a nonmagnetic sleeve containing a magnet inside, a construction in which toner can further be added is desirable in terms of cost. In this case, a construction in which durability is extended by having more magnetic particles for charging than the minimum in the charger and recycling them is preferable.

Mechanical stirring, or building a magnetic pole that can recycle the magnetic particles, or providing a member that can move the magnetic particles in a container that stores the magnetic particles is a preferable means of recycling. For example, a screw member for stirring behind the magnetic brush, or a construction for providing a repellent pole and recoating the magnetic particles while tearing them off, or providing of a baffle member for preventing the flow of magnetic particles may be mentioned.

Below, examples of the present invention are described. However, the present invention is not limited to these examples. First, an example of the construction, material, and manufacture method of the members used in the present invention is given.

(Manufacture Method of Magnetic Particles for Charging Example 1: Preparation Example 1)

0.05 parts by mass of phosphorous was added to 100 parts by mass of 53 mol % $Fe_2O_3$, 24 mol % CuO and 23 mol % ZnO, pulverized with a ball mill, and mixed. Dispersing agent, binding agent and water were added. After a slurry formed, particle formation was performed with a spray dryer. After classifying appropriately, it was calcinated at 1100° C. in the open air.

It was classified after pulverizing the ferrite obtained, and ferrite particles with an average particle diameter of 50 $\mu$m were obtained. The volume resistance value for the ferrite particles was $1\times10^7$ Ωcm. The characteristics are shown in Table 1. The shape of the particles was an extremely satisfactory sphere.

(Manufacture Method of Magnetic Particles for Charging Example 2: Preparation Example 2)

54 mol % $Fe_2O_3$, 30 mol % MnO, and 16 mol % MgO were pulverized and with a ball mill and mixed. Dispersing agent, binding agent and water were added. After a slurry formed, particle formation was performed with a spray dryer. After classifying appropriately, it was calcinated at 1200° C. in an atmosphere with an adjusted oxygen density and pulverization and classification were performed. Ferrite particles with an average particle diameter of 55 $\mu$m and a volume resistance value of $3\times10^7$ Ωcm were obtained. The shape of the particles was an extremely satisfactory sphere. The characteristics are shown in Table 1.

(Manufacture Method of Magnetic Particles for Charging Example 3: Preparation Example 3)

Ferrite particles were manufactured in the same way as in (Manufacture Method of Magnetic Particles for Charging Example 1) except that after producing particles with the spray dryer, the classification conditions were changed and narrow particles were gathered. The average particle diameter was 27 $\mu$m. The characteristics are shown in Table 1.

(Manufacture Method of Magnetic Particles for Charging Example 4: Preparation Example 4)

Ferrite particles were manufactured in the same way as in (Manufacture Method of Magnetic Particles for Charging Example 1) except that after producing particles with the spray dryer, the classification conditions were changed and narrow particles were gathered. The average particle diameter was 15 $\mu$m. The characteristics are shown in Table 1.

(Manufacture Method of Magnetic Particles for Charging Example 5: Preparation Example 5)

Ferrite particles were manufactured in the same way as in (Manufacture Method of Magnetic Particles for Charging Example 2) except that 3 parts by mass of phosphorous was added to 100 parts by mass of the starting materials used in Example 2, and lumps of ferrite in which particles were sintered together were obtained. The lumps were repeatedly pulverized with a hammer mill, then pulverized with an oscillating ball, and classified appropriately. Ferrite particles with an average particle diameter of 26 $\mu$m were obtained. The characteristics are shown in Table 1.

(Manufacture Method of Magnetic Particles for Charging Example 6: Preparation Example 6)

Ferrite particles with an average particle diameter of 27 $\mu$m were obtained by pulverizing the mixture from (Manufacture method of magnetic particles for charging Example 1) with an air current type jet mill. The characteristics are shown in Table 1.

(Manufacture Method of Magnetic Particles for Charging Example 7: Preparation Example 7)

After pulverizing the mixture from Manufacture Method of Magnetic Particles for Charging Example 2) with an air current type jet mill, the powder was cut with a wind powered classifier. The characteristics are shown in Table 1.

(Manufacture Method of Magnetic Particles for Charging Example 8: Preparation Example 8)

50 parts by mass of (Manufacture Method of Magnetic Particles for Charging Example 3) and 50 parts by mass of (Manufacture Method of Magnetic Particles for Charging Example 6) were mixed. The characteristics are shown in Table 1.

(Manufacture Method of Magnetic Particles for Charging Example 9: Preparation Example 9)

80 parts by mass of (Manufacture Method of Magnetic Particles for Charging Example 3) and 20 parts by mass of (Manufacture Method of Magnetic Particles for Charging Example 6) were mixed. The characteristics are shown in Table 1.

(Manufacture Method of Magnetic Particles for Charging Example 10: Preparation Example 10)

(Manufacture Method of Magnetic Particles for Charging Example 4) was heated in nitrogen and low resistance particles were obtained. The characteristics are shown in Table 1.

(Manufacture Method of Magnetic Particles for Charging Example 11: Preparation Example 11)

70 parts by mass of (Manufacture Method of Magnetic Particles for Charging Example 3) and 30 parts by mass of (Manufacture Method of Magnetic Particles for Charging Example 10) were mixed. The characteristics are shown in Table 1.

(Manufacture Method of Magnetic Particles for Charging Example 12: Preparation Example 12)

100 parts by mass of magnetic particles manufactured as in (Manufacture Method of Magnetic Particles for Charging Example 6) were added to a solution of 0.07 parts by mass dodecyl trimethoxy silane, which is a silane coupling agent, dissolved in 20 parts by mass of methyl ethyl ketone and maintained at 70° C. while stirring. After the solvent evaporated, it was placed in a 150° C. oven and cured. The characteristics are shown in Table 1.

(Manufacture Method of Magnetic Particles for Charging Example 13: Preparation Example 13)

100 parts by mass of magnetic particles manufactured as in (Manufacture Method of Magnetic Particles for Charging Example 6) were added to a solution obtained by dissolving 0.03 parts by mass of isopropoxytriisostearolyl titanate, which is a titanium coupling agent, in 20 parts by mass of toluene, and the mixture was then maintained at 70° C. while stirring. After the solvent evaporated, it was placed in a 200° C. oven and cured. The characteristics are shown in Table 1.

(Manufacture Method of Magnetic Particles for Charging Example 14: Preparation Example 14)

70 parts by mass of (Manufacture Method of Magnetic Particles for Charging Example 4) and 30 parts by mass of (Manufacture Method of Magnetic Particles for Charging Example 5) were mixed. The characteristics are shown in Table 1.

(Charging Magnetic Particle Manufacture Example 15: Preparation Example 15)

| | |
|---|---|
| $Fe_2O_3$ | 83 mol % |
| $Li_2CO_3$ | 17 mol % |

To 100 parts by mass of the above, 0.8 part by mass of phosphorus was added, ground in a ball mill, mixed, and formed into slurry by adding a dispersant, bonding agent and water thereto. Thereafter, a granulation operation was performed by a spray drier. After appropriate classification was performed, oxygen concentration was adjusted, and calcining was performed in 1200° C.

After obtained ferrite was ground/treated, the classification was performed, to obtain particles of an average particle diameter of 50 μm and particles (A) of 27 μm. The particles both have very excellent spherical shapes.

Subsequently, the ferrite particles with the average particle diameter of 50 μm were shaped with an air current type jet mill, and classified by an air classifier, to obtain particles (B) having an average particle diameter of 27 μm. Subsequently, 20 parts by mass of the shaped particles (B) and 80 parts by mass of the particles (A) were mixed, to obtain ferrite particles having a volume resistance value of $3\times10^7$ Ωcm. Characteristics are summarized in Table 1.

(Charging Magnetic Particle Manufacture Example 16: Preparation Example 16)

| | |
|---|---|
| CuO | 6 mol % |
| ZnO | 12 mol % |
| MgO | 41 mol % |
| $Fe_2O_3$ | 41 mol % |

To 100 parts by mass of the above, 1 part by mass of phosphorus was added, ground in a ball mill, mixed, and formed into slurry by adding a dispersant, bonding agent and water thereto. Thereafter, a granulation operation was performed by a spray drier. After appropriate classification was performed, oxygen concentration was adjusted, and calcining was performed at 1200° C.

After obtained ferrite was ground/treated, the classification was performed, to obtain particles of an average particle diameter of 50 μm and particles (C) of 27 μm. The particles both have very excellent spherical shapes.

Subsequently, the ferrite particles with the average particle diameter of 50 μm were shaped with an air current type jet mill, and classified by an air classifier, to obtain particles (D) having an average particle diameter of 27 μm. Subsequently, 20 parts by mass of the shaped particles (D) and 80 parts by mass of the particles (C) were mixed, to obtain ferrite particles having a volume resistance value of $6\times10^7$ Ωcm. Characteristics are summarized in Table 1.

(Charging Magnetic Particle Manufacture Example 17: Preparation Example 17)

| | |
|---|---|
| CuO | 6 mol % |
| ZnO | 11 mol % |
| MgO | 23 mol % |
| MnO | 7 mol % |
| $Fe_2O_3$ | 53 mol % |

To 100 parts by mass of the above, 1 part by mass of phosphorus was added, ground in a ball mill, mixed, and formed into slurry by adding a dispersant, bonding agent and water thereto. Thereafter, a granulation operation was performed by a spray drier. After appropriate classification was performed, oxygen concentration was adjusted, and calcining was performed at 1200° C.

After obtained ferrite was ground/treated, the classification was performed, to obtain particles of an average particle diameter of 50 μm and particles (E) of 27 μm. The particles both have very excellent spherical shapes.

Subsequently, the ferrite particles with the average particle diameter of 50 μm were shaped with an air current type jet mill, and classified by an air classifier, to obtain particles (F) having an average particle diameter of 27 μm. Subsequently, 20 parts by mass of the shaped particles (F) and 80 parts by mass of the particles (E) were mixed, to obtain ferrite particles having a volume resistance value of $7\times10^6$ Ωcm. Characteristics are summarized in Table 1.

(Charging Magnetic Particle Manufacture Example 18: Preparation Example 18)

| | |
|---|---|
| MnO | 57 mol % |
| $Fe_2O_3$ | 43 mol % |

The above was ground in a ball mill, mixed, and formed into slurry by adding a dispersant, bonding agent and water thereto. Thereafter, a granulation operation was performed by a spray drier. After appropriate classification was performed, oxygen concentration was adjusted, and calcining was performed at 1200° C.

After obtained ferrite was ground/treated, the classification was performed, to obtain particles of an average particle diameter of 50 μm and particles (G) of 27 μm. The particles both have very excellent spherical shapes.

Subsequently, the ferrite particles with the average particle diameter of 50 μm were shaped with an air current type jet mill, and classified by an air classifier, to obtain particles (H) having an average particle diameter of 27 μm. Subsequently, 20 parts by mass of the shaped particles (H) and 80 parts by mass of the particles (G) were mixed, to obtain ferrite particles having a volume resistance value of $7\times10^6$ Ωcm. Characteristics are summarized in Table 1.

(Charging Magnetic Particle Manufacture Example 19: Preparation Example 19)

| | |
|---|---|
| NiO | 25 mol % |
| ZnO | 22 mol % |
| $Fe_2O_3$ | 53 mol % |

To 100 parts by mass of the above, 1 part by mass of phosphorus was added, ground in a ball mill, mixed, and formed into slurry by adding a dispersant, bonding agent and water thereto. Thereafter, a granulation operation was performed by a spray drier. After appropriate classification was performed, oxygen concentration was adjusted, and calcining was performed at 1200° C.

After obtained ferrite was ground/treated, the classification was performed, to obtain particles of an average particle diameter of 50 μm and particles (I) of 27 μm. The particles both have very excellent spherical shapes.

Subsequently, the ferrite particles with the average particle diameter of 50 μm were shaped with an air current type jet mill, and classified by an air classifier, to obtain particles (J) having an average particle diameter of 27 μm. Subsequently, 20 parts by mass of the shaped particles (J) and 80 parts by mass of the particles (I) were mixed, to obtain ferrite particles having a volume resistance value of $4\times10^7$ Ωcm. Characteristics are summarized in Table 1.

(Charging Magnetic Particle Manufacture Example 20: Preparation Example 20)

Iron powder was ground/classified, and subjected to surface oxidation to obtain particles with an average particle diameter of 25 μm. The volume resistance value is $3\times10^3$ Ωcm. Characteristics are summarized in Table 1.

(Charging Magnetic Particle Manufacture Example 21: Preparation Example 21)

After 100 parts by weight of stainless resin and 300 parts by weight of magnetite particles with an average particle diameter of 0.2 μm were molten/kneaded, grinding/classification was performed, so that particles with an average particle diameter of 25 μm were obtained. The volume resistance value is $5\times10^9$ Ωcm. Characteristics are summarized in Table 1.

(Charging Magnetic Particle Manufacture Example 22: Preparation Example 22)

After (charging magnetic particles 2) were ground in a vibrating mill, the powder was finely cut by air classification, so that ferrite particles with an average particle diameter of 12 μm were obtained. Characteristics are summarized in Table 1.

(Manufacturing Method of Photosensitive Member Example 1)

Five functional layers are built on an aluminum cylinder 0.75 mm thick, 30 mm diameter.

The first layer is an undercoating layer. It is an electroconductive layer, approximately 20 μm thick, built to level defects in the aluminum cylinder and to prevent the generation of moire due to reflections from laser exposure.

The second layer is a positive electric charge injection prevention layer. It prevents a positive electric charge injected from the aluminum cylinder from denying a negative electric charge charged to the surface of the photosensitive member and is a medium resistance layer approximately 1 μm thick resistance adjusted to about $10_6$ Ωcm by Amilan resin and methoxy methylated nylon.

The third layer is an electric charge generation layer. It is approximately 0.3 μm thick made of oxytitanium phthalocyanine pigment dispersed in resin and generates positive and negative electric charges by receiving laser exposure.

The fourth layer is a charge transport layer made of hydrazone dispersed in polycarbonate resin and is a P-type semiconductor. Accordingly it cannot move a negative electric charge charged to the surface of the photosensitive member, but can only convey a positive electric charge generated by the electric charge generation layer to the surface of the photosensitive member. It is 15 μm thick and the volume resistance value of the electric charge transport layer is $3\times10^{15}$ Ωcm.

The fifth layer is a charge injection layer. The charge injection layer is made of superfine particles of $SnO_2$ dispersed in photohardening acrylic resin. To be exact, it consists of 150 parts by mass antimony doped, low resistance $SnO_2$ particles with an average particle diameter of 0.03 μm to 100 parts by mass of acrylic resin, with 1.2 parts by mass of dispersing agent, and 20 parts by mass of tetra-fluoroethylene resin particles dispersed within. It is 2.5 μm thick and the volume resistance value of the charge injection layer is $2\times10^{13}$ Ωcm.

(Manufacturing Method of Photosensitive Member Example 2)

Photosensitive member manufactured in the same way as Manufacturing Method of Photosensitive member, Example 1, except that an aluminum cylinder 1.0 mm thick, 30 mm diameter is used.

(Manufacturing Method of Photosensitive Member Example 3)

Photosensitive member manufactured in the same way as Manufacturing Method of Photosensitive member, Example 1, except that an aluminum cylinder 2.5 mm thick, 30 mm diameter is used.

(Manufacturing Method of Photosensitive Member Example 4)

Photosensitive member manufactured in the same way as Manufacturing Method of Photosensitive member, Example 1, except that an aluminum cylinder 3.5 mm thick, 30 mm diameter is used.

(Manufacturing Method of Developer Example 1)

| | |
|---|---|
| Polyester resin | 100 parts by mass |
| Metal containing azo dye | 2 parts by mass |
| Low molecular weight polypropylene | 3 parts by mass |
| Carbon black | 5 parts by mass |

After dry mixing the above materials, they are kneaded with a dual axis kneading extruder set at 150° C. The kneaded material obtained is cooled and a toner combined material with adjusted particle size distribution is obtained by wind power classification after micropulverizing with a draft type pulverizer. 1.6% by mass of titanium oxide subjected to hydrohobic treatment is added to this toner combination material and toner with a weight-average particle diameter of 7.1 μm is produced. A developer is obtained by mixing 6 parts by mass of the toner with 100 parts by mass of nickel zinc ferrite with average particle size of 50 μm coated with silicone resin.

(Manufacturing Method of Developer Example 2)

| | |
|---|---|
| Styrene | 88 parts by mass |
| n-butyl acrylate | 12 parts by mass |
| Divinylbenzene | 0.2 parts by mass |
| Low molecular weight polypropylene | 3 parts by mass |
| Carbon black | 4 parts by mass |
| Metal-containing azo dye | 1.2 parts by mass |
| Azo group initiator | 3 parts by mass |

The above materials are dispersion mixed and the above solution is added to 500 parts by mass of pure water with 4 parts by mass of calcium phosphate dispersed within it, and dispersed with a homomixer. The polymer obtained by polymerizing for 8 hours at 70° C. is then filtrated, washed, and afterwards dry classified to obtain a toner combination material.

1.4% by mass of titanium oxide subjected to hydrohobic treatment is added to the above toner combination material to produce a toner with weight-average diameter of 6.4 μm. The obtained toner is formed with a polymerization method and shows a spherical shape when observed under an electron microscope. A developer is obtained by mixing 6 parts by mass of the toner with 100 parts by mass of nickel zinc ferrite with average particle size of 50 μm coated with silicone resin.

Next the present invention is explained using the equipment and methods for evaluation used in the examples and comparative examples of the present invention and using the examples and comparative examples.

(Digital Copying Machine 1)

A digital copying machine (Canon GP55) using a laser beam was prepared as the electrophotographic apparatus. This device is equipped with a corona charger as the primary charging means of the photosensitive member, a one component developer employing a one component jumping development method as the developing means, a corona charger as the transfer means, a blade cleaning means, and a precharging exposure means. The charging for primary charging of the photosensitive member and the cleaning means form a single unit (a process cartridge). The process speed is 150 mm/s. This digital copying machine is then modified as follows.

First, the process speed is changed to 200 mm/s. The developing portion is modified from one component jumping to a developer that can use two component developers. Also, a 16 diameter electroconductive nonmagnetic sleeve with a magnet roller inside is set up as the primary charging means and a magnetic brush for charging is formed. The minimum gap between the electroconductive sleeve for charging and the photosensitive member is set at 0.5 mm. The developing bias is set at a direct current of −500 V with a peak-peak voltage (Vpp) of 1,000 V and rectangular waves with a frequency of 3 KHz. The transfer means using a corona charger is changed to a roller transfer means and the pre-charging exposure means is removed. The cleaning blade is also removed and the device is converted to a cleanerless copying machine. FIG. 1 shows a schematic view. In the Figure, 101 is a fixer, 102 is the charger, 103 is the magnetic particles for charging, 104 is the electroconductive sleeve housing a magnet roller, 105 is the photosensitive member, 106 is the exposing light, 107 is the developing sleeve, 108 is the developer device, 109 and 110 are stirring screws, 111 is the developer, 112 is a paper conveying guide, 113 is transfer paper, 114 is a transfer roller, 115 is a paper conveying belt, 116 is the process cartridge, and 117 is the developing cartridge.

Using the digital copying machine 1, a charger with coating density of the magnetic particles of 180 mg/cm$^2$ and the photosensitive member are assembled. In order to set up the charger with a coating density of magnetic particles of 180 mg/cm$^2$, a minimum of approximately 30 g of magnetic particles is necessary. Then the magnetic brush charger is rotated in a reverse direction from the contact point with the photosensitive member. At this time the peripheral speed of the charger rotation is 240 mm/s.

The bias applied to the charging member is set at a direct current voltage of −700 V with rectangular wave oscillating voltage of 1 Khz and 700 Vpp. The developing bias is set to a direct current voltage of −500 V and rectangular wave alternating current voltage of 1,000 Vpp and 3 Khz. Under conditions of 15° C. temperature and 10% relative humidity, character images (A4) at a 3% image ratio are formed. Evaluation of the images obtained is performed by eye.

Then a durability test is performed as follows. 400 cycles of 50 sheets, in other words 20,000 sheets, are copied in consecutive mode at a peripheral speed of rotation of 300 mm/s and a character image (A4) with an image ratio of 3% and the images are evaluated in the same way as in the initial period. At this time, a rectangular wave alternating voltage of 1 KHz and 500 Vpp and a direct current voltage of −700 V are applied to the portion where no images are to be formed during continuous paper feed, when charging prior to image formation on the initial sheet (before rotation), and during charging of the photosensitive member after completion of image formation on the 50$^{th}$ sheet, the toner within the magnetic brush for charging is moved to the photosensitive member while charging the photosensitive member, and the toner is then absorbed by the developing portion.

The above evaluation is performed using (Manufacturing Method of Magnetic Particles Example 6), (Manufacturing Method of Developer Example 2), and (Manufacturing Method of Photosensitive Member Example 1). During the durability test, the noise generated by interference between the photosensitive member and the magnetic particles for charging due to voltage applied to the charging member was at an almost unnoticeable level.

The result at a peripheral speed of rotation of the charger of 240 mm/s was an image with essentially no fog, a superb result. Continuing the durability test further, up to 60,000 sheets were tested and the photosensitive member was changed as fog resulted due to erosion of the photosensitive member at 50,000 sheets. Still the image quality was superb with no fog. The magnetic particles for charging were sampled at every 20,000 sheets and the amount of contamination was measured. The amount of contamination is expressed as a percentage of the sample amount, found by subtracting the weight reduction of the magnetic particles when heated in a nitrogenous environment from 150° C. to 400° C. before use from the weight reduction of the particles when heated after use.

The results are shown in Table 2. When the friction charging of the toner used in (Manufacture Method of Magnetic Particles Example 6) and (Manufacture Method of Developer Example 2) was confirmed, it was a minus of the same polarity as the charging polarity of the photographic material of the Example.

(Examples 2 to 7)

These Examples were evaluated in the same way as Example 1, combined as in Table 2. The results are shown in Table 2. During the durability test of each Example, the noise generated by interference between the photosensitive member and the magnetic particles for charging due to voltage applied to the charging member was at an almost unnoticeable level.

When the friction charging of the toner used in (Manufacture Method of Developer Example 1) and (Manufacture Method of Developer Example 2) and the magnetic particles used in Examples 2 to 7 were confirmed, they were a minus, which is the same polarity as the charging polarity of the photographic material of the Example.

(Examples 8 and 9)

These Examples were evaluated in the same way as Example 1, combined as in Table 2. The results are shown in Table 2. During the durability test of each Example, the noise generated by interference between the photosensitive material and the magnetic particles for charging due to voltage applied to the charging member was at an almost unnoticeable level. Also, there was no need to change the photosensitive material even at 50,000 sheets.

When the friction charging of the toner used in (Manufacture Method of Developer Example 2) and the magnetic particles used in Examples 8 and 9 were confirmed, they were a minus, which is the same polarity as the charging polarity of the photographic material of the Example.

(Examples 10 to 15)

The same evaluation as in Example 1 was made in accordance with combinations in Table 2. The results are all shown in Table 2.

In Example 10, fog slightly occurred at 60,000 sheets. In Examples 11, 12 and 13, ferrite particles using copper and manganese gave good results, and therefore the above-mentioned fog can be considered to be caused by the use of lithium.

In Example 14, particularly much contamination was not observed at 40,000 sheets and the standard deviation of the short axis/long axis length was 0.1, and therefore, the contamination itself was inhibited to a low level, but owing to the use of nickel, the fog slightly occurred.

(Comparative Examples 1 to 5)

These Examples were evaluated in the same way as the Example, combined as in Table 2. The results are shown in Table 2. However, because the noise generated by interference between the photosensitive material and the magnetic particles for charging due to voltage applied to the charging member during image formation was at a slightly bothersome level, an aluminum cylinder 3.5 mm thick (Manufacturing Method of Photosensitive Material Example 4) was used to lower the noise to an unnoticeable level.

According to the results of the above Comparative Examples, the initial period in Comparative Example 1 was superb in terms of fog. However at 40,000 sheets fog began to stand out a bit in the image and the contamination amount was quite large as 0.85%. This is thought to be caused by the fact that the standard deviation of the ratio of the short axis/long axis length of the magnetic particles used is small.

In Comparative Example 2, not only is the standard deviation small, but the volume resistance value of the charging particles is too low, resulting in abnormal images from the initial period on. In Comparative Example 3, there were no problems in the initial period, but because the standard deviation was small and the volume resistance value of the magnetic particles having particle diameters of 5 to 20 μm was slightly low, the magnetic particles gradually leaked out and leak images arose that are thought to be caused by an imbalance of low resistance particles.

In Comparative Example 4, the resistance value was too low, and a leak image appeared from an initial stage.

In Comparative Example 5, a fog image appeared from the initial stage. This was caused by the standard deviation being small and the resistance value being excessively high.

TABLE 1

| Preparation Example for Magnetic Particle | Average particle diameter (μm) | Standard deviation of short axis/long axis length: Not less than 5 μm | Standard deviation of short axis/long axis length: 5–20 μm | Volume resistance value (Ωcm), 5–20 μm | Volume resistance Value (Ωcm), More than 20 μm | Volume resistance value (Ωm), whole resistance | $X_1$/Y Element/Fe atom number ratio |
|---|---|---|---|---|---|---|---|
| Example 1 | 50 | 0.05 | 0.05 | — | — | $1 \times 10^7$ | — |
| Example 2 | 55 | 0.06 | 0.06 | — | — | $3 \times 10^7$ | — |
| Example 3 | 27 | 0.05 | 0.06 | — | — | $3 \times 10^7$ | — |
| Example 4 | 15 | 0.07 | 0.07 | — | — | $6 \times 10^7$ | — |
| Example 5 | 26 | 0.15 | 0.14 | $1 \times 10^8$ | $6 \times 10^7$ | $8 \times 10^7$ | Mn/Fe = 0.28 |
| Example 6 | 27 | 0.14 | 0.15 | $5 \times 10^7$ | $1 \times 10^7$ | $3 \times 10^7$ | Cu/Fe = 0.23 |
| Example 7 | 26 | 0.12 | 0.13 | $7 \times 10^7$ | $4 \times 10^7$ | $5 \times 10^7$ | Mn/Fe = 0.28 |
| Example 8 | 27 | 0.14 | 0.14 | $4 \times 10^7$ | $2 \times 10^7$ | $3 \times 10^7$ | Cu/Fe = 0.23 |
| Example 9 | 27 | 0.1 | 0.12 | $4 \times 10^7$ | $3 \times 10^7$ | $3 \times 10^7$ | Cu/Fe = 0.23 |
| Example 10 | 15 | 0.07 | 0.07 | — | — | $9 \times 10^3$ | Cu/Fe = 0.23 |
| Example 11 | 23 | 0.06 | 0.07 | $6 \times 10^5$ | $1 \times 10^7$ | $5 \times 10^6$ | Cu/Fe = 0.23 |
| Example 12 | 27 | 0.14 | 0.15 | $5 \times 10^7$ | $1 \times 10^7$ | $3 \times 10^7$ | Cu/Fe = 0.23 |
| Example 13 | 27 | 0.14 | 0.15 | $5 \times 10^7$ | $1 \times 10^7$ | $3 \times 10^7$ | Cu/Fe = 0.23 |
| Example 14 | 18 | 0.15 | 0.08 | $6 \times 10^7$ | $6 \times 10^7$ | $6 \times 10^7$ | Cu/Fe = 0.23 |

TABLE 1-continued

| Preparation Example for Magnetic Particle | Average particle diameter (μm) | Standard deviation of short axis/long axis length: Not less than 5 μm | Standard deviation of short axis/long axis length: 5–20 μm | Volume resistance value (Ωcm), 5–20 μm | Volume resistance Value (Ωcm), More than 20 μm | Volume resistance value (Ωm), whole resistance | $X_1$/Y Element/Fe atom number ratio |
|---|---|---|---|---|---|---|---|
| | | | | | | | Mn/Fe = 0.28 |
| Example 15 | 27 | 0.1 | 0.12 | $4 \times 10^7$ | $3 \times 10^7$ | $3 \times 10^7$ | Li/Fe = 0.20 |
| Example 16 | 27 | 0.1 | 0.12 | $7 \times 10^7$ | $6 \times 10^7$ | $6 \times 10^7$ | Cu/Fe = 0.073 |
| Example 17 | 27 | 0.1 | 0.12 | $4 \times 10^7$ | $3 \times 10^7$ | $4 \times 10^7$ | Cu/Fe = 0.057 |
| | | | | | | | Mn/Fe = 0.066 |
| Example 18 | 27 | 0.1 | 0.12 | $8 \times 10^6$ | $7 \times 10^6$ | $7 \times 10^6$ | Mn/Fe = 0.66 |
| Example 19 | 27 | 0.1 | 0.12 | $4 \times 10^7$ | $4 \times 10^7$ | $4 \times 10^7$ | Cu/Fe = 0.00 |
| | | | | | | | Mn/Fe = 0.00 |
| | | | | | | | Li/Fe = 0.00 |
| Example 20 | 25 | 0.07 | 0.07 | — | — | $3 \times 10^3$ | Cu/Fe = 0.00 |
| | | | | | | | Mn/Fe = 0.00 |
| | | | | | | | Li/Fe = 0.00 |
| Example 21 | 25 | 0.07 | 0.07 | — | — | $5 \times 10^9$ | — |
| Example 22 | 12 | 0.14 | 0.16 | $2 \times 10^8$ | $9 \times 10^7$ | $1 \times 10^8$ | Mn/Fe = 0.28 |

TABLE 2

| | Photo-sen-sitive Member | Magnetic Particle | Developer | Initial (a) | Initial (b) | 20,000 Sheets (a) | 20,000 Sheets (b) | 40,000 Sheets (a) | 40,000 Sheets (b) | 60,000 sheets (a) | 60,000 sheets (b) | Note |
|---|---|---|---|---|---|---|---|---|---|---|---|---|
| Example 1 | 1 | 6 | 2 | Good | 0.00 | Good | 0.01 | Good | 0.03 | Good | 0.07 | (1) |
| Example 2 | 2 | 7 | 2 | Good | 0.00 | Good | 0.01 | Good | 0.05 | Good | 0.08 | (1) |
| Example 3 | 3 | 8 | 2 | Good | 0.00 | Good | 0.04 | Good | 0.07 | Good | 0.13 | (1) |
| Example 4 | 4 | 9 | 2 | Good | 0.00 | Good | 0.06 | Good | 0.21 | Good | 0.30 | (1) |
| Example 5 | 1 | 9 | 1 | Good | 0.00 | Good | 0.10 | Good | 0.30 | Good | 0.61 | (1) |
| Example 6 | 1 | 5 | 2 | Good | 0.00 | Good | 0.07 | Good | 0.23 | Good | 0.29 | (1) |
| Example 7 | 1 | 14 | 2 | Good | 0.00 | Good | 0.15 | Good | 0.34 | Slight Fog | 0.60 | (1) |
| Example 8 | 1 | 12 | 2 | Good | 0.00 | Good | 0.02 | Good | 0.03 | Good | 0.05 | |
| Example 9 | 1 | 13 | 2 | Good | 0.00 | Good | 0.02 | Good | 0.03 | Good | 0.05 | |
| Example 10 | 1 | 15 | 1 | Good | 0.00 | Good | 0.11 | Good | 0.35 | Slight Fog | 0.64 | (1) |
| Example 11 | 1 | 16 | 1 | Good | 0.00 | Good | 0.09 | Good | 0.29 | Good | 0.58 | (1) |
| Example 12 | 1 | 17 | 1 | Good | 0.00 | Good | 0.10 | Good | 0.33 | Good | 0.60 | (1) |
| Example 13 | 1 | 18 | 1 | Good | 0.00 | Good | 0.10 | Good | 0.30 | Good | 0.61 | (1) |
| Example 14 | 1 | 19 | 1 | Good | 0.00 | Good | 0.10 | Slight Fog | 0.35 | Slight Fog | 0.55 | (1) |
| Example 15 | 1 | 22 | 1 | Good | 0.00 | Good | 0.05 | Good | 0.10 | Good | 0.22 | (2) |
| Comparative Ex. 1 | 4 | 3 | 1 | Good | 0.00 | Good | 0.49 | Slight Fog | 0.85 | — | — | |
| Comparative Ex. 2 | 4 | 10 | 1 | Abnormal Image | — | — | — | — | — | — | — | (3) |
| Comparative Ex. 3 | 4 | 11 | 1 | Good | 0.00 | Slight Fog | 0.59 | Foggy Image | 1.01 | — | — | (4) |
| Comparative Ex. 4 | 4 | 20 | 1 | Leak Image | — | — | — | — | — | — | — | |
| Comparative Ex. 5 | 4 | 21 | 1 | Foggy Image | — | — | — | — | — | — | — | |

Note:
(a) Image Quality
(b) Contamination
(1) Photosensitive member is exchanged at 50,000 sheets.
(2) Photosensitive member is exchanged at 40,000 sheets.
(3) Traces of image leaks are seen at initial period.
(4) Magnetic particle leaks.

What is claimed is:

1. Magnetic particles for charging comprising magnetic particles having particle diameters of 5 μm or more, said magnetic particles having particle diameters of 5 μm or more having a standard deviation of short-axis length/long-axis length of the magnetic particles of 0.08 or more, and a volume resistance value in the range of $10^4$ to $10^9$ Ωcm.

2. Magnetic particles according to claim 1, wherein the standard deviation of short-axis length/long-axis length of magnetic particles having particle diameters of 5 to 20 μm is 0.08 or more.

3. Magnetic particles according to claim 2, wherein the standard deviation is 0.10 or more.

4. Magnetic particles according to claim 1, wherein the magnetic particles are ferrite particules containing iron and at least one of copper, manganese and lithium.

5. Magnetic particles according to claim 4, wherein the magnetic particles are ferrite particles containing iron and at least one of copper and manganese.

6. Magnetic particles according to claim 4, wherein the ferrite particles have a composition represented by the following formula:

$$(A_1)_{x1}\cdot(A_2)_{X2}\ldots(An)_{Xn}\cdot(Fe)_{Y}\cdot(O)_{Z}$$

(in which $A_1$ to An denote elements selected from copper, manganese and lithium, and $X_1$ to Xn and Y denote atom number ratios of contained elements other than oxygen, and satisfy the inequality $0.02<X_1/Y<5$ and z denotes an atom number ratio of oxygen).

7. Magnetic particles according to claim 6, wherein $X_1$ and Y satisfy the following inequality:

$$0.03<X_1/Y<3.5.$$

8. Magnetic particles according to claim 7, wherein $X_1$ and Y satisfy the following inequality:

$$0.05<X_1/Y<1.$$

9. Magnetic particles according to claim 1, wherein the magnetic particles have a volume resistance value in the range of $10^6$ to $10^9$ Ωcm.

10. Magnetic particles according to claim 1, wherein a volume resistance value Ra of magnetic particles having particle diameters of 5 to 20 μm and a volume resistance value Rb of magnetic particles having particle diameters exceeding 20 μm satisfy the following inequality:

$$0.5\leqq Ra/Rb\leqq 5.0.$$

11. Magnetic particles according to claim 10, wherein Ra and Rb satisfy the following inequality:

$$1.0\leqq Ra/Rb\leqq 5.0.$$

12. A charging member comprising:

a magnet body having a conductive portion to which a voltage is applied; and magnetic particles on the magnet body, wherein said magnetic particles comprise magnetic particles having particle diameters of 5 μm or more, said magnetic particles having particle diameters of 5 μm or more having a standard deviation of short-axis length/long-axis length of the magnetic particles of 0.08 or more, and a volume resistance value in the range of $10^4$ to $10^9$ Ωcm.

13. A charging member according to claim 12, wherein the standard deviation of short-axis length/long-axis length of magnetic particles having particle diameters of 5 to 20 μm is 0.08 or more.

14. A charging member according to claim 13, wherein the standard deviation is 0.10 or more.

15. A charging member according to claim 12, wherein the magnetic particles are ferrite particles containing iron and at least one of copper, manganese and lithium.

16. A charging member according to claim 15, wherein the magnetic particles are ferrite particles containing iron and at least one of copper and manganese.

17. A charging member according to claim 15, wherein a composition ratio of the ferrite particles is represented by the following formula:

$$(A_1)_{x1}\cdot(A_2)_{X2}\ldots(An)_{Xn}\cdot(Fe)_{Y}\cdot(O)_{z}$$

(in which $A_1$ to An denote elements selected from copper, manganese and lithium, and $X_1$ to Xn and Y denote atom number ratios of contained elements other than oxygen, and are satisfy the inequality $0.02<X_1/Y<5$ and z denotes an atom number ratio of oxygen).

18. A charging member according to claim 17, wherein $X_1$ and Y satisfy the following inequality:

$$0.03<X_1/Y<3.5.$$

19. A charging member according to claim 18, wherein $X_1$ and Y satisfy the following inequality:

$$0.05<X_1/Y<1.$$

20. A charging member according to claim 12, wherein the volume resistance value of the magnetic particles is in the range of $10^6$ to $10^9$ Ωcm.

21. A charging member according to claim 12, wherein a volume resistance value Ra of magnetic particles having particle diameters of 5 to 20 μm and a volume resistance value Rb of magnetic particle diameters exceeding 20 μm satisfy the following inequality:

$$0.5\leqq Ra/Rb\leqq 5.0.$$

22. A charging member according to claim 21, wherein Ra and Rb satisfy the following inequality:

$$1.0\leqq Ra/Rb\leqq 5.0.$$

23. A charging member according to claim 12, wherein the magnet body comprises a conductive sleeve incorporating a magnet.

24. A charging device comprising a charging member disposed in contact with an image carrier to charge the image carrier when a voltage is applied thereto, said charging member comprising a magnet body having a conductive portion to which the voltage is applied and magnetic particles on the magnet body, said magnetic particles comprising magnetic particles having particle diameters of 5 μm or more, said magnetic particles having particle diameters of 5 μm or more having a standard deviation of short-axis length/long-axis length of the magnetic particles of 0.08 or more, and a volume resistance value in the range of $10^4$ to $10^9$ Ωcm.

25. A charging device according to claim 24, wherein the standard deviation of short-axis length/long-axis length of magnetic particles having particle diameters of 5 to 20 μm is 0.08 or more.

26. A charging device according to claim 25, wherein the standard deviation is 0.10 or more.

27. A charging device according to claim 24, wherein the magnetic particles are ferrite particles containing iron and at least one of copper, manganese and lithium.

28. A charging device according to claim 27, wherein the magnetic particles are ferrite particles containing iron and at least one of copper and manganese.

29. A charging device according to claim 27, wherein a composition ratio of the ferrite particles is represented by the following formula:

$$(A_1)_{x1}\cdot(A_2)_{X2}\ldots(An)_{Xn}\cdot(Fe)_{Y}\cdot(O)_{Z}$$

(in which $A_1$ to An denote elements selected from copper, manganese and lithium, and $X_1$ to Xn and Y denote atom number ratios of contained elements other than oxygen, and are satisfy the inequality $0.02<X_1/Y<5$ and z denotes an atom number ratio of oxygen).

30. A charging device according to claim 29, wherein $X_1$ and Y satisfy the following inequality:

$$0.03<X_1/Y<3.5.$$

31. A charging device according to claim 30, wherein $X_1$ and Y satisfy the following inequality:

$$0.05<X_1/Y<1.$$

32. A charging device according to claim 24, wherein the volume resistance value of the magnetic particles is in the range of $10^6$ to $10^9$ Ωcm.

33. A charging device according to claim 24, wherein a volume resistance value Ra of magnetic particles having particle diameters of 5 to 20 μm and a volume resistance value Rb of magnetic particles having particle diameters exceeding 20 μm satisfy the following inequality:

$$0.5\leqq Ra/Rb\leqq 5.0.$$

34. A charging device according to claim 33, wherein Ra and Rb satisfy the following inequality:

$$1.0\leqq Ra/Rb\leqq 5.0.$$

35. A charging device according to claim 24, wherein the magnet body comprises a conductive sleeve incorporating a magnet.

36. A charging device according to claim 24, wherein the image carrier is an electrophotographic photosensitive member having a photosensitive layer on a support.

37. A charging device according to claim 36, wherein the electrophotographic photosensitive member has a charge injection layer as a surface layer.

38. A charging device according to claim 36, wherein the support has a thickness of 0.5 to 3.0 mm.

39. A process cartridge comprising an electrophotographic photosensitive member; and a charging member disposed in contact with the electrophotographic photosensitive member to charge the electrophotographic photosensitive member when a voltage is applied thereto, the electrophotographic photosensitive member and the charging member being integrally supported, and detachably attached to a main body of an electrophotographic apparatus, said charging member comprising a magnet body having a conductive portion to which the voltage is applied and magnetic particles on the magnet body, said magnetic particles comprising magnetic particles having particle diameters of 5 μm or more, said magnetic particles having particle diameters of 5 μm or more having a standard deviation of short-axis length/long-axis length of the magnetic particles of 0.08 or more, and a volume resistance value in the range of $10^4$ to $10^9$ Ωcm.

40. A process cartridge according to claim 39, wherein the standard deviation of short-axis length/long-axis length of magnetic particles having particle diameters of 5 to 20 μm is 0.08 or more.

41. A process cartridge according to claim 40, wherein the standard deviation is 0.10 or more.

42. A process cartridge according to claim 39, wherein the magnetic particles are ferrite particles containing iron and at least one of copper, manganese and lithium.

43. A process cartridge according to claim 42, wherein the magnetic particles are ferrite particles containing iron and at least one of copper and manganese.

44. Magnetic particles according to claim 42, wherein a composition ratio of the ferrite particles is represented by the following formula:

$$(A_1)_{x1}\cdot(A_2)_{X2}\ldots(An)_{Xn}\cdot(Fe)_{Y}\cdot(O)_{Z}$$

(in which $A_1$ to An denote elements selected from copper, manganese and lithium, and $X_1$ to Xn and Y denote atom number ratios of contained elements other than oxygen, and satisfy the inequality $0.02<X_1/Y<5$ and z denotes an atom number ratio of oxygen).

45. A process cartridge according to claim 44, wherein $X_1$ and Y satisfy the following inequality:

$$0.03<X_1/Y<3.5.$$

46. A process cartridge according to claim 45, wherein $X_1$ and Y satisfy the following inequality:

$$0.05<X_1/Y<1.$$

47. A process cartridge according to claim 39, wherein the volume resistance value of the magnetic particles is in the range of $10^6$ to $10^9$ Ωcm.

48. A process cartridge according to claim 39, wherein a volume resistance value Ra of magnetic particles having particle diameters of 5 to 20 μm and a volume resistance value Rb of magnetic particles having particle diameters exceeding 20 μm satisfy the following inequality:

$$0.5\leqq Ra/Rb\leqq 5.0.$$

49. A process cartridge according to claim 48, wherein Ra and Rb satisfy the following inequality:

$$1.0\leqq Ra/Rb\leqq 5.0.$$

50. A process cartridge according to claim 39, wherein the magnet body comprises a conductive sleeve incorporating a magnet.

51. A process cartridge according to claim 39, wherein said electrophotographic photosensitive member has a photosensitive layer on a support.

52. A process cartridge according to claim 51, wherein the electrophotographic photosensitive member has a charge injection layer as a surface layer.

53. A process cartridge according to claim 51, wherein the support has a thickness of 0.5 to 3.0 mm.

54. An electrophotographic apparatus comprising an electrophotographic photosensitive member; a charging means having a charging member disposed in contact with the electrophotographic photosensitive member to charge the electrophotographic photosensitive member when a voltage is applied thereto; a developing means; and a transfer means, said charging member comprising a magnet body having a conductive portion to which the voltage is applied and magnetic particles on the magnet body, said magnetic particles comprising magnetic particles having particle diameters of 5 μm or more, said magnetic particles having particle diameters of 5 μm or more having a standard deviation of short-axis length/long-axis length of the magnetic particles of 0.08 or more, and a volume resistance value in the range of $10^4$ to $10^9$ Ωcm.

55. An electrophotographic apparatus according to claim 54, wherein the standard deviation of short-axis length/long-axis length of magnetic particles having article diameters of 5 to 20 μm is 0.08 or more.

56. An electrophotographic apparatus according to claim 55, wherein the standard deviation is 0.10 or more.

57. An electrophotographic apparatus according to claim 54, wherein the magnetic particles are ferrite particles containing iron and at least one of copper, manganese and lithium.

58. An electrophotographic apparatus according to claim 57, wherein the magnetic particles are ferrite particles containing iron and at least one of copper and manganse.

59. An electrophotographic apparatus according to claim 57, wherein a composition ratio of the ferrite particles is represented by the following formula:

$$(A_1)_{x1}.(A_2)_{X2} \ldots (An)_{Xn}.(Fe)_{Y}.(O)_{Z}$$

(in which $A_1$ to An denote elements $A_1$ selected from copper, manganese and lithium, and $X_1$ to Xn and Y denote atom number ratios of contained elements other than oxygen, and satisfy the inequality $0.02<X_1/Y<5$ and z denotes an atom number ratio of oxygen).

60. An electrophotographic apparatus according to claim 59, wherein $X_1$ and Y satisfy the following inequality:

$$0.03<X_1/Y<3.5.$$

61. An electrophotographic apparatus according to claim 60, wherein $X_1$ and Y satisfy the following inequality:

$$0.05<X_1/Y<1.$$

62. An electrophotographic apparatus according to claim 54, wherein the volume resistance value of the magnetic particles is in the range of $10^6$ to $10^9$ Ωcm.

63. An electrophotographic apparatus according to claim 54, wherein a volume resistance value Ra of magnetic particles having particle diameters of 5 to 20 μm and a volume resistance value Rb of magnetic particles having particle diameters exceeding 20 μm satisfy the following inequality:

$$0.5 \leqq Ra/Rb \leqq 5.0.$$

64. An electrophotographic apparatus according to claim 63, wherein Ra and Rb satisfy the following inequality:

$$1.0 \leqq Ra/Rb \leqq 5.0.$$

65. An electrophotographic apparatus according to claim 54, wherein the magnet body comprises a conductive sleeve incorporating a magnet.

66. An electrophotographic apparatus according to claim 54, wherein said electrophotographic photosensitive member has a photosensitive layer on a support.

67. An electrophotographic apparatus according to claim 66, wherein the electrophotographic photosensitive member has a charge injection layer as a surface layer.

68. An electrophotographic apparatus according to claim 66, wherein the support has a thickness of 0.5 to 3.0 mm.

69. An electrophotographic apparatus according to claim 54, wherein the developing means is substantially a cleaning means.

* * * * *

UNITED STATES PATENT AND TRADEMARK OFFICE

CERTIFICATE OF CORRECTION

PATENT NO. : 6,157,801
DATED : December 5, 2000
INVENTOR(S) : Shuichi Aita et al.

It is certified that error appears in the above-identified patent and that said Letters Patent is hereby corrected as shown below:

Column 5,
Line 13, "alien" should be deleted.

Column 7,
Line 39, "particules" should read -- particles --.

Column 8,
Line 11, "rates" should read -- ratio --.

Column 10,
Line 28, "used" should read -- be used --.

Column 16,
Line 22, "and" (first occurrence) should be deleted.

Column 20,
Line 30, "$10_6$" should read as -- $10^6$ --.

Column 27,
Line 2, "particules" should read -- particles --.

Column 28,
Line 6, "are" should be deleted.

Column 29,
Line 2, "are" should be deleted.

UNITED STATES PATENT AND TRADEMARK OFFICE

CERTIFICATE OF CORRECTION

PATENT NO. : 6,157,801
DATED : December 5, 2000
INVENTOR(S) : Shuichi Aita et al.

It is certified that error appears in the above-identified patent and that said Letters Patent is hereby corrected as shown below:

Column 30,
Line 10, "elements" should read -- elements $A_1$ --.

Column 31,
Line 20, "A1" (second occurrence) should be deleted.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*